United States Patent [19]

Thompson

[11] 4,203,595

[45] May 20, 1980

[54] BASEBALL FIELDERS SIGNALING APPARATUS

[76] Inventor: James E. Thompson, 4201 Don Tomaso Dr., Apt. 8, Los Angeles, Calif. 90008

[21] Appl. No.: 848,082

[22] Filed: Nov. 3, 1977

[51] Int. Cl.[2] ..... A63B 71/00

[52] U.S. Cl. ..... 273/25; 455/351

[58] Field of Search ..... 273/26 R, 55 R, 29 R, 273/25; 325/53, 54, 64, 55

[56] References Cited

U.S. PATENT DOCUMENTS

| | | | |
|---|---|---|---|
| 2,508,613 | 5/1950 | Lang | 325/53 |
| 3,478,344 | 11/1969 | Schwitzgebel | 325/64 |
| 3,492,582 | 1/1970 | Heywood | 325/16 |
| 3,889,190 | 6/1975 | Palmer | 325/16 |
| 3,983,483 | 9/1976 | Pando | 325/16 |

*Primary Examiner*—Richard C. Pinkham
*Assistant Examiner*—T. Brown
*Attorney, Agent, or Firm*—William P. Green

[57] ABSTRACT

Apparatus for preventing injury to fielders, including control means to be actuated by a coach or other person or persons, and separate fielder units to be carried by different fielders and adapted to receive radio signals from the control means and produce signals which can be sensed by the fielder to indicate to him which of the fielders is nearer to the ball and should field it.

13 Claims, 5 Drawing Figures

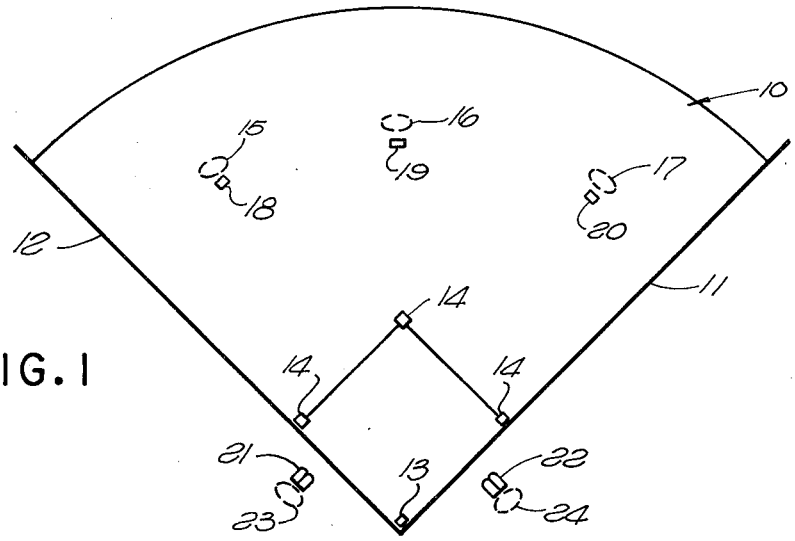
FIG. 1
FIG. 2
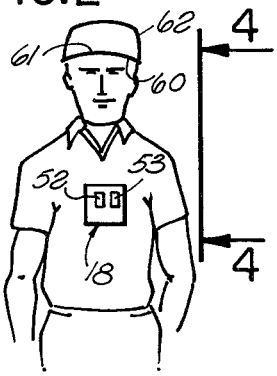
FIG. 4
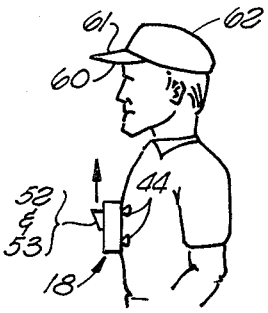
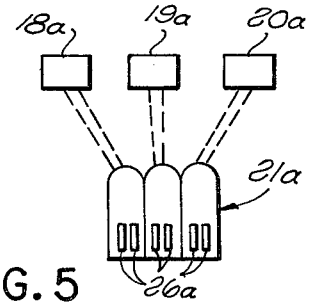
FIG. 5
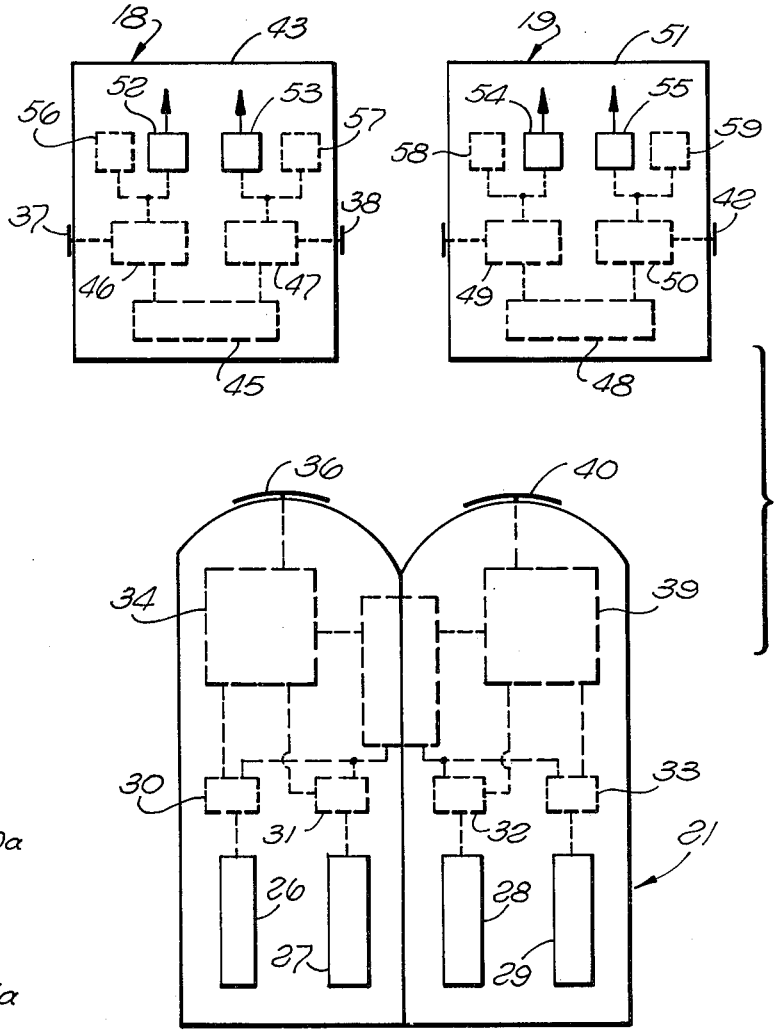
FIG. 3

BASEBALL FIELDERS SIGNALING APPARATUS

BACKGROUND OF THE INVENTION

This invention relates to improved apparatus and methods for preventing injuries resulting from collisions between two fielders in a baseball game.

Each year, a number of injuries to baseball players occur when two outfielders attempt to field the same batted ball. Though in most instances, one of the outfielders will see at an early stage that he can definitely reach the ball, and will by appropriate predetermined signal notify the other fielders of that fact, and thereby cause them to back off and allow him to catch the ball, there are some instances in which neither fielder can tell whether he or another fielder is closer to the ball, and consequently both fielders continue running to the ball and make the best effort they can to catch it. When this type of situation occurs, there may be a disastrous collision between the two players, both running at top speed toward the ball, and running directly into each other while both are looking toward the ball and neither can see the other player. Serious injuries can result which can sideline a player for many months, or could perhaps terminate his career.

SUMMARY OF THE INVENTION

The present invention provides unique apparatus and a unique method for effectively preventing such collisions between two players attempting to field the same ball. To achieve this result, I utilize signaling devices by which a coach, coaches, or other persons at the side of the playing field can send instructions to a pair of outfielders notifying them as to which one should attempt to field a particular batted ball, and which one should back away to avoid collision. Preferably, two coaches at opposite sides of the field have devices for transmitting radio signals to the fielders, with each device preferably sending signals to the center fielder and one of the two other fielders, in particular, the other fielder who happens to be nearer the particular side of the field at which the specified control unit is located. Each of the fielders has a receiving unit, which receives the radio signals and produces visual, audible, or other sensible signals which can be sensed in some way by the fielder.

The invention is not intended as an aid to the fielders for increasing the number of outs which they can make, though this may be an inherent unintended result achieved, but instead the primary purpose is solely to prevent accidents. Since all team managements and players should have a common desire to minimize unnecessary injuries, it is contemplated that they may be able to agree on alteration of the rules of the game, if necessary, to permit use of the equipment of the present invention to reduce the possibility of injury on all teams.

BRIEF DESCRIPTION OF THE DRAWING

The above and other features and objects of the invention will be better understood from the following detailed description of the typical embodiments illustrated in the accompanying drawing in which:

FIG. 1 is a diagrammatic view representing a baseball playing field and the manner in which signaling devices embodying the present invention are positioned and utilized on the field;

FIG. 2 is a front view of an outfielder carrying a fielders unit embodying the invention;

FIG. 3 is an enlarged view showing somewhat diagrammatically one of the control units and two of the fielder units of the invention;

FIG. 4 is a side view of one of the fielder units and a fielders' cap, taken on line 4—4 of FIG. 2; and FIG. 5 is a view similar to FIG. 3, but showing a variational arrangement.

DETAILED DESCRIPTION OF THE PREFERRED EMBODIMENTS

Referring first to FIG. 1, there is illustrated at 10 a conventional baseball playing field, with the first and third base lines being designated 11 and 12 respectively and meeting at home plate 13. The bases are shown at 14, and the three outfielders are represented diagrammatically at 15 (left fielder), 16 (center fielder), and 17 (right fielder). The three fielders carry three separate receiving units or fielders units 18, 19 and 20, which receive signals from two control units 21 and 22 carried by two coaches 23 and 24 typically located near the third and first base lines respectively.

FIG. 3 shows in enlarged form the control unit 21 and the two fielders units 18 and 19 associated therewith. The second control unit 22 is constructed the same way as unit 21 except that the radio signals emitted thereby are of a character to be received only by the two fielders units 19 and 20, rather than units 18 and 19.

As seen in FIG. 3, control unit 21 includes a housing 25 which is small enough to be held in the hand of a coach or other person sending signals to the outfielders, and which has a first pair of manually actuated elements 26 and 27 for sending signals to left fielder 15, and a second pair of manually actuated elements 28 and 29 for sending signals to the center fielder 16. The elements 26, 27, 28 and 29 may be push-buttons, or as illustrated may be elongated bars which are manually depressable relative to the housing 25. Depression of any of the elements 24, 25, 26 or 27 actuates a corresponding electrical switch 30, 31, 32 or 33 in housing 25.

A first radio transmitter 34 within housing 25, energized by a battery 35 within the housing, acts to transmit radio signals from an antenna 36 to receiving antennas 37 and 38 of unit 18 carried by the left fielder. A second similar transmitter 39 transmits radio waves from an antenna 40 of unit 21 to receiving antennas 41 and 42 of the center fielders unit 19.

The radio signals transmitted from antennas 36 and 40 are of four different types for the four control elements 26, 27, 28 and 29 respectively, and are recognized and received individually by the units 18 and 19. That is, the radio signal emitted from antenna 36 when element 26 is pressed is different than the signal emitted when each of the other elements 27, 28 and 29 is pressed, and similarly the signal produced by depression of element 27 is different than each of the three other signals produced when elements 26, 28 and 29 are actuated, etc. For example, the four signals produceable by unit 21 may be of different frequencies recognizable by units 18 and 19.

Referring now the upper portion of FIG. 3, the fielders unit 18 includes a housing 43 which is adapted to be attached to a wearer's uniform, typically at the front of his shirt as illustrated in FIGS. 2 and 4. For this purpose, the back of housing 43 may have pins 44 or other fastening elements for securing the unit to the shirt. Contained within the housing, there may be a battery 45 energizing two radio receivers 46 and 47, which are tuned to receive only signals of the particular characteristic frequencies emitted when elements 26 and 27 respectively are depressed.

The center fielders unit 19 is constructed the same as unit 18, having a battery 48 and two radio receivers 49 and 50 within a housing 51, but with the two transmitters 49 and 50 being tuned to receive and respond to the radio signals transmitted by antenna 40 when elements 28 and 29 respectively are depressed.

Each of the receivers 46, 47, 49 and 50 acts when its corresponding characteristic radio signal is received to energize an associated electric lamp 52, 53, 54 or 55, and an associated buzzer, bell, or other sound producing unit 56, 57, 58, or 59. The light produced by lamps 52 and 54 may be of a first color or characteristic (typically red), to indicate to that particular fielder that he is not to attempt to field a certain ball, while the other two lamps 53 and 55 may be of another color or characteristic (typically green), to indicate that the carrying fielder is to make the play. Similarly, the sound produced by each of the units 56, 57, 58 and 59 can be different than the other three units, to be audibly discernable for indicating whether the particular fielder is or is not to make the play. It is contemplated that in some instances only the visual signal producing units may be employed, or only the audible signal producing units may be employed, or alternatively other types of units producing sensible signals may be provided, such as for example vibrators or the like which when operated may be felt by the fielder.

As seen in FIG. 4, the lamps 52, 53, etc. may be carried by units 18 or 19 in a manner directing the emitted light upwardly toward the face of the fielder, and a light reflective surface, such as a layer of white cloth or a light, may be provided at the underside 60 of the bill 61 of each players' cap 62. This surface 60 can then reflect the upwardly directed red or green light back toward the eyes of the player, to assure that he receives the visual signal.

The second control unit 22 at the second side of the playing field acts upon depression of two of its control elements 26 and 27, or 28 and 29, to emit two characteristic radio signals, having the same frequencies as are produced by depression of elements 28 and 29 of unit 21, to thereby transmit signals to the same center fielders unit 19 as are sent from one side of unit 21. The other two frequencies emitted by the second control unit 22 are entirely different than the signals produced by any of the elements of unit 21, to be receivable only by the right fielders unit 20, to indicate to him whether he should or should not make a play.

Describing now a cycle of use of the units 18, 19 and 21 of FIG. 3, assume that a ball has been batted to a location between the center fielder 16 and left fielder 15, and that these two fielders are not readily able to tell for themselves which should make the play on the ball. As soon as the coach 23 is able to determine from his vantage point which of the fielders has the best opportunity of reaching the ball, he presses appropriate ones of the elements 26 to 29 to communicate appropriate instructions to fielders 15 and 16. If he feels that fielder 15 should make the catch, the coach presses elements 27 and 28 of unit 21 in FIG. 3. Depression of element 27 throws a switch 31 to cause energization of transmitter 34 to emit from antenna 36 a receiving signal to which only the radio receiver 48 is tuned. The signal is received by that receiver 47 and causes illumination of lamp 53 and energization of sound producing unit 57 to indicate to fielder 15 that he is to make the play. Depression of element 28 similarly causes transmission of a radio signal of a characteristic frequency from antenna 40, to which signal only the receiver 49 is tuned, to cause energization of lamp 54 and sound producing unit 58 indicating to center fielder 16 that he is not to make the play. If the center fielder is the one who should make the catch in a particular situation, the elements 26 and 29 are pressed, to give the green light to the center fielder and the red light to the left fielder. When the ball is between the center fielder and the right fielder, the second coach 24 similarly actuates the appropriate pressable elements of unit 22, to transmit a go-ahead radio signal to one of the fielders 16 or 17, and a contrary signal to the other fielder.

In the variational FIG. 5 arrangement, a single control unit **21*a* is provided, having six manually depressable elements 26*a* arranged in three pairs for sending radio signals of six different frequencies to the three fielder units 18*a*, 19*a* and 20*a* corresponding to units 18, 19 and 20 in FIG. 1. One coach may thus hold the unit 21*a*, and actuate appropriate ones of the elements 26*a*** to give to each of the fielders a sensible signal to either make the catch or hold back and allow another player to field the ball.

While certain specific embodiments of the present invention have been disclosed as typical, the invention is of course not limited to these particular forms, but rather is applicable broadly to all such variations as fall within the scope of the appended claims.

I claim:

1. Baseball fielder signaling apparatus comprising:

control means to be operated by a person or persons positioned to view at least two fielders in a baseball game, and including radio transmitter means operable to transmit selectively different radio signals under the control of said person or persons for instructing adjacent fielders as to which should attempt to field a particular batted ball;

a plurality of fielder units each unit to be carried on the person of a fielder and each including receiver circuitry for receiving said transmitted signals from said control means, and means operable by said receiver circuitry to produce output signals controlled by said radio signals and which can be sensed by the fielder and indicate to him which of the fielders is to field the ball;

said means operable by said receiver circuitry including light emitting means responsive to said radio signals, and reflector means for reflecting light from said light emitting means toward the eyes of the fielder; and caps carried by said fielders and having bills carrying said reflector means at their undersides.

2. Baseball fielder signaling apparatus comprising:

control means to be operated by a person positioned to view two adjacent first and second fielders in a baseball game, and including radio transmitter means operable to transmit selectively two different radio signals under the control of said person for instructing said adjacent fielders as to which should attempt to field a particular batted ball;

said control means including manually operated means actuable by said person between a first condition causing said transmitter means to transmit a first of said radio signals and a second condition causing said transmitter means to transmit a second of the radio signals; and first and second fielder units constructed and adapted to be worn by said two adjacent fielders respectively during a game in a manner avoiding substantial interference with their movements in fielding a ball;

said first fielder unit being constructed to receive said first radio signal and produce in response thereto but not in response to said second signal an output which can be sensed by the first fielder and indicate to him whether he is to field the ball;

said second fielder unit being constructed to receive said second radio signal and produce in response thereto but not in response to said first radio signal an output which can be sensed by the second fielder and indicate to him whether he is to field the ball.

3. Baseball fielders signaling apparatus as recited in claim 2, including additional control means to be operated by a second person positioned to view said second fielder and a third fielder, and including additional radio transmitter means operable to transmit selectively two different radio signals under the control of said second person for instructing said second and third fielders as to which should attempt to field a particular batted ball;

said additional control means including additional manually operable means actuable by said second person between different conditions for transmitting different radio signals; and a third fielder unit constructed to be worn by said third fielder during a game in a manner avoiding substantial interference with his movements in fielding a ball;

said second and third fielder units being constructed to receive said different signals respectively transmitted by said additional transmitter means and produce outputs which can be sensed by said second and third fielders to indicate which of them is to field a particular ball.

4. Baseball fielder signaling apparatus as recited in claim 3, in which one of said radio signals transmitted by said additional transmitter means corresponds to said second signal produced by said first mentioned transmitter means so that said second fielder unit can be controlled by either of said control means to instruct said second player whether he is to field a particular ball.

5. Baseball fielder signaling apparatus as recited in claim 2, in which said outputs produced by said first and second signals indicate to the respective fielders that they are to field the ball; said transmitter means being actuable by said manually operable means to transmit two additional signals receivable by said two fielder units respectively, said fielder units having means responsive to said additional signals to produce outputs instructing the respective fielders not to field a particular ball.

6. Baseball fielder signaling apparatus as recited in claim 2, in which each of said fielder units includes two lights visible by a fielder wearing that particular unit and giving different visible signals controlled by said transmitter means to indicate to the fielder that he is to field a particular batted ball if a first of the lights is on and that he is not to field the ball if a second of the lights is on.

7. Baseball fielders signaling apparatus as recited in claim 2, in which each of said fielder units includes light emitting means controlled by said transmitter means, and reflector means for reflecting light from said light emitting means toward the eyes of the fielder.

8. Baseball fielders signaling apparatus as recited in claim 7, including caps carried by said fielders and having bills carrying said reflector means at their undersides.

9. Baseball fielders signaling apparatus as recited in claim 2, in which said fielder units include sound producing means responsive to said radio signals for producing two different sounds indicating which of said two fielders is to field a particular batted ball.

10. Baseball fielders signaling apparatus as recited in claim 2, in which said fielder units include both light emitting means and sound emitting means producing visible and audible output signals controlled by said radio signals for indicating which of two fielders is to field a ball.

11. Baseball fielders signaling apparatus as recited in claim 2, including a third fielder unit to be carried by a third fielder, said control means including a single control unit in which said transmitter means are operable to transmit a third radio signal in addition to said first and second signals, said manually operated means being operable to actuate said transmitter means to transmit said third signal; said third fielder unit being responsive to said third radio signal to produce an output instructing said third fielder whether he is to field a particular batted ball.

12. Baseball fielders signaling apparatus as recited in claim 2, in which said control means include a single control unit to be held by a person; said transmitter means being operable to transmit third and fourth radio signals in addition to said first and second signals; said manually operated means including four manually actuated switches each operable when actuated to cause said transmitter means to transmit one and only one of said four radio signals, said first fielder unit being constructed to receive said third radio signal but not said fourth signal, said second fielder unit being constructed to receive said fourth radio signal but not said third radio signal, said first fielder unit being responsive to said first and third radio signals to produce different outputs adapted to be sensed by the corresponding fielder and instruct him whether he is or is not to field a particular ball, and said second fielder unit being constructed to respond to said second and fourth radio signals to produce two different outputs instructing said second fielder whether he is or is not to field a particular ball.

13. Baseball fielders signaling apparatus as recited in claim 2, including a third of said fielder units to be worn by a third fielder, said control means including a single control unit operable to transmit six different radio signals, only two of which are receivable by each of said fielder units, said manually operated means including six manually actuated elements operable to actuate said transmitter means to transmit said six different radio signals respectively; each of said fielder units being operable to produce two different outputs in response to two of said radio signals respectively which can be sensed by a corresponding one of the players to indicate whether he should or should not field a particular ball.

* * * * *